US007370763B1

(12) United States Patent
Pascucci

(10) Patent No.: US 7,370,763 B1
(45) Date of Patent: May 13, 2008

(54) HEALTH MANAGEMENT KIT

(76) Inventor: Cheryl L. Pascucci, 349 Coles Meadow Rd., Northampton, MA (US) 01060

( * ) Notice: Subject to any disclaimer, the term of this patent is extended or adjusted under 35 U.S.C. 154(b) by 447 days.

(21) Appl. No.: 10/955,418

(22) Filed: Dec. 8, 2004

(51) Int. Cl.
*B65D 69/00* (2006.01)

(52) U.S. Cl. ..... 206/569; 206/232; 206/570

(58) Field of Classification Search ..... 206/216, 206/223, 569–572, 37, 38, 232; 422/50, 422/61; 600/300, 301, 309
See application file for complete search history.

(56) References Cited

U.S. PATENT DOCUMENTS

| | | | | |
|---|---|---|---|---|
| 4,197,842 | A | 4/1980 | Anderson | |
| 4,386,642 | A | 6/1983 | Durbin | |
| 4,429,793 | A | 2/1984 | Ehmann | |
| 4,498,590 | A | 2/1985 | Burdick | |
| 4,513,866 | A * | 4/1985 | Thomas | 206/570 |
| 4,828,113 | A | 5/1989 | Friedland et al. | |
| 5,515,974 | A | 5/1996 | Higson | |
| 5,544,753 | A * | 8/1996 | Monica | 206/570 |
| 5,833,330 | A * | 11/1998 | Kos | 206/570 |
| 5,931,791 | A | 8/1999 | Saltzstein et al. | |
| 6,460,702 | B2 | 10/2002 | Hammond | |
| 6,575,904 | B2 * | 6/2003 | Nagai et al. | 600/301 |
| 6,579,271 | B1 | 6/2003 | Aruffo et al. | |
| 6,602,469 | B1 * | 8/2003 | Maus et al. | 422/68.1 |
| 6,622,856 | B2 | 9/2003 | Gallo et al. | |
| 6,848,581 | B2 * | 2/2005 | Cohen | 206/570 |
| 2001/0037215 | A1 | 11/2001 | Sparks | |
| 2003/0038047 | A1 * | 2/2003 | Sleva et al. | 206/370 |
| 2003/0154981 | A1 | 8/2003 | Spruiell | |
| 2005/0029156 | A1 * | 2/2005 | Girzaitis | 206/570 |

OTHER PUBLICATIONS

Report of the U.S. Preventive Services Task Force, "Guide to Clinical Preventive Services", 2nd ed., Alexandria, Virginia, International Medical Publishing, Secs i,iii & iv.

* cited by examiner

*Primary Examiner*—Luan K Bui
(74) *Attorney, Agent, or Firm*—Deborah A. Basile; Karen K. Chadwell

(57) ABSTRACT

Disclosed herein is a health management kit comprising a carrier; a means for detecting an organism's vital signs, wherein such means are held by the carrier, and wherein the vital signs comprise at least one of heart rate, blood pressure, glucose levels, cholesterol levels, and hemorrhaging; and a means for recording the organism's vital signs, wherein such means are held by the carrier; whereby the organism's vital signs may be detected and recorded, and thereby monitored, by a non-medical practitioner to better manage the physical health of the organism.

7 Claims, 2 Drawing Sheets

HEALTH MANAGEMENT KIT

BACKGROUND OF THE INVENTION

1. Field of the Invention

In general, disclosed herein is a health management kit. More particularly, disclosed herein is a health management kit that allows a user to monitor and manage an organism's health by promoting preventive measures to maximize the health of the organism and to allow for a heightened awareness of the organism's physical condition in relation to the organism's daily activities.

2. Background of the Invention

As the literature supports, preventive steps for the early detection of disease greatly reduces the onset of morbidity and mortality. For example, referring to "The Guide to Clinical Preventive Services", "age-adjusted mortality from stroke has decreased by more than 50% since 1972, a trend attributed in part to earlier detection and treatment of hypertension." "The Guide to Clinical Preventive Services", 2nd ed., International Medical Publishing, Inc. (1998), pp. XXV-XXVI. Stressing the importance of preventive measures, "The Guide to Clinical Preventive Services" states: "[a]lthough immunizations and screening tests remain important preventive services, the most promising role for prevention in current medical practice may lie in changing the personal health behaviors of patients long before clinical disease develops. The importance of this aspect of clinical practice is evident from a growing literature linking some of the leading causes of death in the U.S. . . . to a handful of personal health behaviors." Id. at XXVI. Unfortunately, for a variety of reasons, including, for example, inadequate reimbursement for preventive services, fragmentation of health care delivery, insufficient time with patients to deliver the range of preventive services that are recommended, and uncertainty among clinicians as to which services should be offered, patients are not receiving the full benefit of the preventive measures currently available. See Id.

Accordingly, what is needed is a device wherein a user can perform particular physical health checks on a regular basis such that the user can better monitor, and hence manage, his or another's physical health, wherein such testing would check for vital signs that are often linked with a particular illness or disease. Such a kit would further causally link behavioral patterns, such as overeating, smoking, and the like, to the vital signs by allowing the user to record the vital signs as well as behavioral patterns, such as, caloric intake, number of cigarettes smoked on a particular day, exercise, and the like.

Such regular testing, documenting, and monitoring of an organism's vital signs are important as these actions may lead to the early detection of aberrant physical conditions, such as, for example, hypertension, diabetes, hyperlipidemia, internal hemorrhaging, anemia, and the like, such that the afflicted individual can reduce or eliminate the condition prior to the development of an illness or disease associated with the condition.

Accordingly, what is needed in the art is a health management kit that provides a user with the means to detect, record, and monitor certain physical conditions or vital signs, such as, for example, heart rate, blood pressure, glucose levels, cholesterol levels, body mass index, weight, hemorrhaging, and the like, wherein such physical conditions oftentimes result in or indicate the presence of disease. Detecting, recording, and monitoring these vital signs can better manage an organism's physical health. Additionally, should a user of the health management kit notice any aberrations in vital signs, the user will be more likely to consult with a primary care provider sooner than if the health management was not conducted.

In addition to a health management kit that allows a user to easily determine, document, and monitor vital signs, further needed is a health management kit that also allows for the documentation and tracking of physical activities that tend to affect physical health, wherein such physical activities may include, for example, caloric intake, exercise, cigarette smoking, and the like. Also, in order to interpret the results of the various tests and/or devices that detect the vital signs, what is needed is a health management kit that includes informational materials such as guidelines indicating normal vital signs for a particular height, weight, sex, and age. Also needed, is a health management kit that provides an exercise means for engaging an organism in physical activity, such that the vital signs of the organism may be taken after the organism has participated in such physical activity. Also needed is a tool to allow the user to assess for risk factors for disease.

Furthermore, what is needed is a health management kit that allows for the ready storage and portable carry of the detection, documentation, and exercise means, and of the information materials. Such a carrier will better ensure that the means and informational materials are readily available and will reduce the chance of misplacing any particular component belonging in the health management kit. Additionally, the carrier will better allow a user to use the health management kit both at home and in public.

SUMMARY OF THE INVENTION

The above-discussed and other drawbacks and deficiencies of the prior art are overcome or alleviated by a health management kit comprising a carrier; a means for detecting an organism's vital signs, wherein such means are held by the carrier, and wherein the vital signs comprise at least one of heart rate, blood pressure, glucose levels, cholesterol levels, and hemorrhaging; and a means for recording the organism's vital signs, wherein such means are held by the carrier; whereby the organism's vital signs may be detected and recorded, and thereby monitored, by a non-medical practitioner in order to better manage the physical health of the organism.

DETAILED DESCRIPTION OF THE INVENTION

Figure 1:
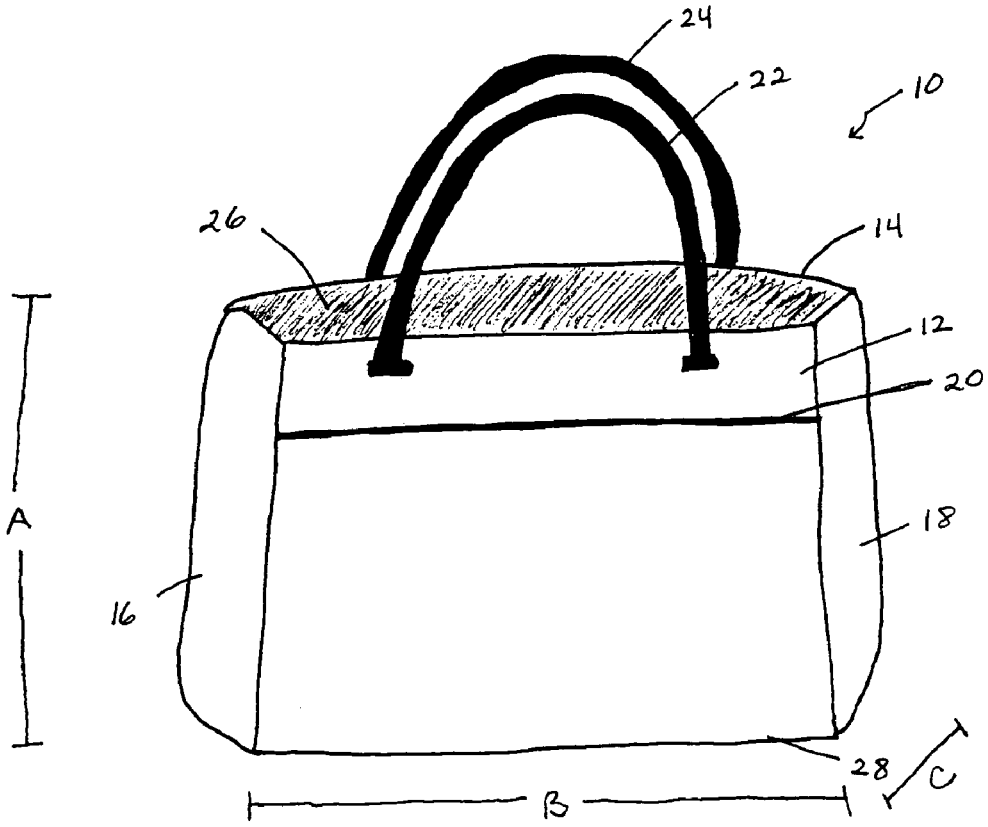
FIG. 1 is a schematic depicting an exemplary carrier.

In general, disclosed herein is a health management kit. More particularly, disclosed herein is a health management kit that allows for the detection, recording, and monitoring of an organism's vital statistics in relation to its physical activities. The health management kit further allows for the detection of the early onset of a physical malady inflicting an organism. Furthermore, the health management kit allows a user to detect the progression or regression of an already incurred physical malady. As used herein and throughout, the term "organism" refers to any class of the animal phylum, wherein mammals are preferred, and wherein humans are especially preferred. As used herein and throughout, the term "user" refers to a person conducting the test(s), recording the vital signs, or monitoring the vital signs, wherein the user may or may not be the same entity as the organism (hence, the kit provides for a self-care health management system).

The health management kit contemplated herein comprises means for the monitoring of an organism's physical condition or vital signs, wherein the vital signs may comprise at least one of heart rate, blood pressure, glucose levels, cholesterol levels, and internal hemorrhaging. The specific means by which the vital signs may be detected comprise those tests and/or devices that are conventionally known in the art, examples of which are included immediately as follows without limitation. For example, means for measuring heart rate may comprise a heart rate monitor; an ear sensor; means for measuring blood pressure may comprise a mercury sphygmomanometer, an aneroid sphygmomanometer, a semi-automated device, an automated device, a wrist device, a finger device, an automatic non-invasive blood pressure monitor, an ambulatory blood pressure monitor, and the like; means for measuring glucose levels may comprise glucose meters, such as, Glucometer®, a finger prick testing health management kit, and Food and Drug Administration ("FDA") approved noninvasive blood glucose monitors, such as, the GlucoWatch® G2™ Biographer; means for detecting cholesterol levels may comprise a lipid panel test; and means for detecting internal hemorrhaging may comprise a fecal occult blood test. All of these means include the actual test and/or measuring device, and may further include any element necessary or helpful in the administration of the particular test and/or in the application of the device.

To facilitate the monitoring process, an exemplary health management kit comprises a documentation means whereby a user may record the organism's vital signs over a period of time. Such documentation means may comprise, for example, a notebook, a paper pad, an electronic recording device, and the like.

The health management kit may additionally comprise means whereby activities that affect the health of the organism may be recorded over time, and, thereby, monitored and regulated. Such activity management means may allow for the recordation and monitoring of, for example, at least one of diet and exercise. Exemplary means for managing an organism's diet comprise at least one of a food diary comprising a paper or electronic means, wherein a user may record the specific types and amounts of foods, calories, or fat ingested for a particular day; an electronic food calculator; and the like. Electronic food calculators include, without limitation, electronic devices capable of performing any combination of at least one of the following: calculating calories burned by an activity; calculating the organism's body mass index ("BMI"), basal metabolic rate ("BMR"), and/or resting metabolic rate ("RMR"); tracking calories burned versus calories ingested; calculating calories, nutrition, and net carbohydrates for low carbohydrate diets; comparing foods for high or low protein, fat, carbohydrate, fiber, and/or sodium content; calculating weight loss by time, daily calorie loss, and/or by total weight loss; and the like. Exemplary means for monitoring exercise comprises, for example, a pedometer, whereby the distance traveled by the organism may be monitored, thereby, allowing for the assessment of the organism's mobility; and/or an exercise diary, wherein the diary may be in paper or electronic form, and which may allow a user to enter the type of exercise engaged in by an organism, as well as, the time spent engaging in the exercise and/or the repetitions involved in the exercise, the weights and/or resistance used while engaging in the exercise, and the vital signs of the organism immediately following the exercise.

In an exemplary embodiment, the health management kit further comprises an exercise means by which an organism may stretch and/or strengthen its muscles, elevate its heart rate, improve its physical endurance, and the like. An exemplary exercise means comprises resistance training bands, which are known by persons of ordinary skill in the art. Such resistance training bands typically comprise a closed loop elastic band that may be secured to the foot and/or hand of the organism, and then expanded and contracted in a repetitive fashion.

In an exemplary embodiment, the health management kit further comprises informational materials. Such informational materials may provide a user with reference markers as to ideal body weights, BMIs, blood pressure levels, and cholesterol levels based on factors such as age, sex, and height. The informational materials may also include, for example, questionnaires aimed at allowing a user to assess risk factors for particular diseases, illnesses or physical conditions, e.g., diabetes, hyperlipidemia, hypertension, heart disease, and the like. The informational materials may further include, for example, reference materials to a Web site, which may provide additional information and support to a user. For example, the Web site may provide primary care provider referrals, lawyer referrals, detailed information regarding certain illnesses and diseases, health related consultations, and the like.

In an exemplary embodiment, the health management kit comprises a carrier, wherein the contents of the health management kit may be conveniently stored and secured in a single site thereby reducing the risk of misplacing any of the contents. Although the carrier may comprise a variety of holding devices, such as, a box, a crate, a backpack, a purse, and the like, in a preferred embodiment, the carrier comprises a tote bag wherein the tote bag facilitates the carrying of the various components. Additionally, due to the aesthetic appeal of the tote bag, a user will likely feel more comfortable carrying the health management kit in public, thereby increasing the likelihood that the user will check and/or record the vital signs when most appropriate.

An exemplary carrier is depicted in FIG. 1. Referring to FIG. 1, the carrier comprises a tote bag 10, wherein tote bag 10 comprises a front side 12, a back side 14, and two lateral sides 16, 18. Front side 12 comprises a pocket 20. In an exemplary embodiment pocket 20 holds the instructional materials, along with any paper and/or electronic components used to document the organism's vital signs and activities. Handles 22, 24, by which a user may readily carry tote bag 10, are attached to respective front side 12 and back side 14. Front side 12 is separated from back side 14 by an opening 26 that extends to a bottom 28 of tote bag 10. Although not depicted, opening 26 may be partially or completely closed by a closing element, such as a zipper, button, snap, and the like, as would be understood by one of ordinary skill in the art.

In an exemplary embodiment, tote bag 10 comprises a height A of about 12 inches, a width B of about 15 inches, and a depth C of about 4 inches. Pocket 20 preferably is located at about 8 inches from bottom 28, and preferably can be separated away from front side 12 up to about 15 inches.

Although the carrier may comprise a wide variety of materials, preferred materials comprise polyester, vinyl, canvas, nylon, and the like, as these materials have sufficient durability and pliability, are weather resistant, and are easy to clean. Polyester is especially preferred.

Figure 2:
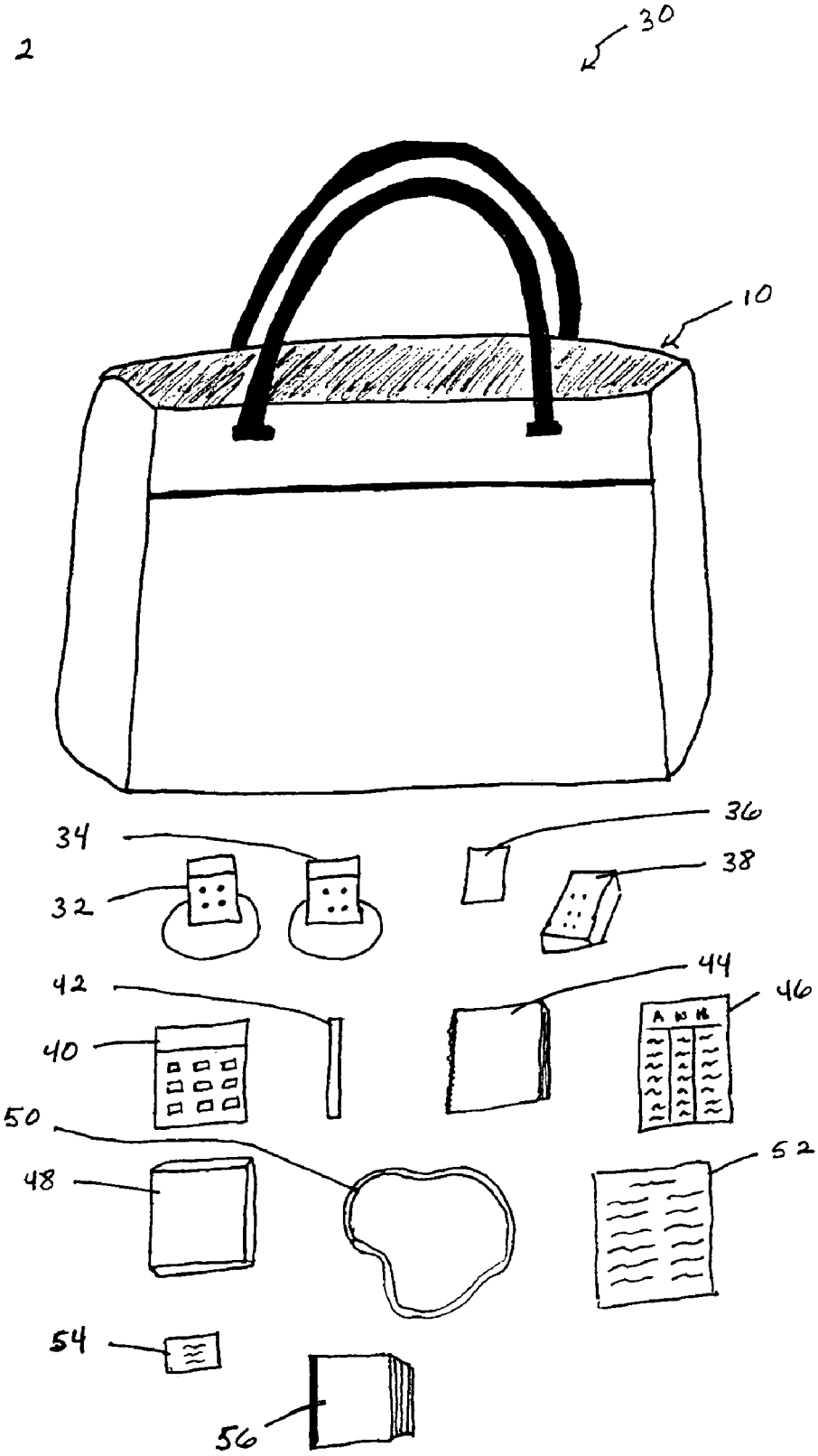
FIG. 2 is a schematic depicting an exemplary health management kit.

An exemplary health management kit is depicted in FIG. 2. Here, a health management kit 30 comprises a tote bag 10 as described above in reference to FIG. 1, and a plurality of components. The plurality of components comprises a blood pressure monitor 32, a heart rate monitor 34, a pedometer 36, a glucose meter 38, a food calculator 40, a cholesterol test 42, an exercise diary 44, a BMI chart 46, a fecal occult blood test 48, a resistance training band 50, a questionnaire to assess risk factors 52, a reference material to an associated supportive Web site 54, and a food diary 56. The means and/or instructional materials discussed above may be positioned in tote bag 10 such that tote bag 10 can hold all of the items. Additionally, the components are preferably placed in tote bag 10 to reduce the likelihood of breakage, tear, or other damage to the components, and to facilitate the ease with which a user may retrieve the desired components.

The health management kit disclosed herein has several advantages over the prior art. For example, the health management kit provides means whereby a non-medical practitioner can manage preventive and health maintenance of an organism's physical health. Such management can occur at locations and at times convenient to the user. Additionally, the means included in the health management kit for determining an organism's vital signs comprise tests and/or devices and related supplies that can be administered safely and simply by non-medical practitioners while still giving accurate results. The health management kit further provides means whereby the vital signs may be recorded, thereby allowing a user to closely monitor the physical condition of the organism. The health management kit also provides means whereby a user can record and document those physical activities that affect the organism's vital signs. For example, the health management kit provides a means, whether it be via paper and/or via electronic form, for recording the amount of exercise engaged in on a particular day, and/or the organism's food intake on any particular day. Accordingly, the health management kit provides a safe, simple, and effective way for a user to monitor the organism's health on a daily basis while taking into account the organism's physical activities, thereby promoting a healthy lifestyle.

Additionally, by providing informational materials as disclosed herein, a user will have guidelines provided that will indicate when the vital signs are normal or abnormal based on certain parameters of the organism, e.g., based on age, height, sex, and weight of the organism. Where the guidelines suggest that the vital signs are aberrant, the user can then make an appointment with a primary care provider. Furthermore, by documenting the organism's vital signs and physical activities over time, the tending primary care provider will have a more reliable history of the organism's health, which will assist the primary care provider in proscribing an individualized treatment regiment based on such history.

Also, by providing a carrier as described herein, the individual contents in the health management kit will be less apt to be misplaced by a user, as the carrier provides a single repository for the items. By providing a carrier as described herein, and particularly a tote bag as described herein, the health management kit may be easily and safely transported. Due to the aesthetic appeal of the tote bag, a user will also be more apt to carry the health management kit out into public and therefore monitor the organism's physical condition in a timely manner.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A health management kit comprising:

a carrier;

a detecting device for detecting an organism's vital signs, wherein the detecting device is held by the carrier, and wherein the vital signs comprise at least one of heart rate, blood pressure, glucose levels, cholesterol levels, and hemorrhaging; and a recording device for recording the organism's vital signs, wherein the recording device is held by the carrier and comprises at least one of a notebook and a paper pad;

a monitoring device for monitoring the organism's physical activities, wherein the monitoring device is held by the carrier, and further wherein the monitoring device comprises at least one of an exercise diary and a food diary;

one or more of an informational insert card, wherein the one or more informational insert provides information as to standard biophysically-related data, and wherein the one or more informational insert is held by the carrier; and an exercise device for stretching and/or enhancing physical flexibility and/or strength of the organism, wherein the exercise device is held by the carrier;

whereby the organism's vital signs and physical activities may be detected and recorded, and thereby monitored, by the organism to manage the physical health of the organism.

2. The health management kit of claim 1, wherein the detecting device for detecting an organism's vital signs comprises a heart rate monitor, a heart pace monitor, a blood pressure monitor, a glucose meter, a total cholesterol kit, and a fecal occult blood test.

3. The health management kit of claim 1, wherein the carrier comprises:

a front side opposite to a back side;

an opening that separates the front side from the back side;

a pocket on an outer surface of the front side;

a first handle on the outer surface of the front side; and a second handle on an outer surface of the back side.

4. The health management kit of claim 3, wherein the monitoring device for monitoring the organism's physical activities comprises a pedometer and an electronic food calculator.

5. The health management kit of claim 3, wherein the means for recording the organism's vital signs further comprises an electronic recording device.

6. The health management kit of claim 3, wherein the exercise device comprises a resistance training band.

7. The health management kit of claim 3, wherein the one or more informational insert card comprises a body mass index chart, a weight chart, a blood pressure level chart, a cholesterol level chart, an insulin level chart, a questionnaire assessing risk factors associated with a particular physical condition and/or a particular disease and/or a particular illness, and a reference material to an Internet Web site.

* * * * *